US006554163B1

(12) United States Patent
Kaye

(10) Patent No.: US 6,554,163 B1
(45) Date of Patent: Apr. 29, 2003

(54) DECORATING AND CUTTING DEVICE

(76) Inventor: Perry Kaye, 11008 Nashville Dr., Cooper City, FL (US) 33026

( * ) Notice: Subject to any disclaimer, the term of this patent is extended or adjusted under 35 U.S.C. 154(b) by 0 days.

(21) Appl. No.: 10/061,653

(22) Filed: Feb. 1, 2002

(51) Int. Cl.[7] ..... B25F 1/04

(52) U.S. Cl. ..... 222/80; 222/191; 222/192; 7/158; 30/162; 30/286; 401/195

(58) Field of Search ..... 7/158, 160; 30/123–125, 30/162, 286, 335; 401/195; 222/80, 191, 192

(56) References Cited

U.S. PATENT DOCUMENTS 1,710,589 A * 4/1929 Pearson ..... 30/123
2,828,855 A * 4/1958 Mosch ..... 172/335
3,257,991 A * 6/1966 Mosch ..... 401/29
3,706,106 A 12/1972 Leopoldi
4,602,397 A 7/1986 Chao
4,635,309 A 1/1987 Larsen
D289,368 S 4/1987 Mann
4,974,319 A * 12/1990 Maguire et al. ..... 30/41
5,557,818 A 9/1996 Leon
6,244,773 B1 6/2001 Geremia-Nargi
D450,086 S 11/2001 Rosenbaum

* cited by examiner

*Primary Examiner*—J. Casimer Jacyna
(74) *Attorney, Agent, or Firm*—Locke Liddell & Sapp LLP

(57) ABSTRACT

A decorating and cutting device includes a housing. A cutting blade and decorating material dispenser are disposed within the housing and are operable to simultaneously dispense decorating material and cut a target material.

23 Claims, 21 Drawing Sheets

DECORATING AND CUTTING DEVICE

TECHNICAL FIELD OF THE INVENTION

The present invention relates generally to the field of decorating and cutting, and more particularly to a device which is operable to perform decorating and/or cutting functions either independently or simultaneously.

BACKGROUND OF THE INVENTION

In crafting and other tasks the operations of cutting and decorating are usually performed separately. This is why there are many different types of cutting tools and many different types of decorating tools.

Felt tip markers are able to efficiently, and for a low cost, provide their users with an ability to decorate items and material like cloth, paper, plastics, cardboard, wood and other porous and non-porous material. Felt tip markers have a felt nib that is connected to an ink or decorating material storage and transference system. The ink or decorating material is drawn from the storage system, usually by capillary or wicking action, and moistens the nib to allow the nib to transfer the ink or decorating material to a target material.

A major problem with markers involves the durability of the nib. When most markers are used their nibs begin to distort due to the pressure placed on them and the rapid reversal of forces caused by the changing direction of the drawing and writing process. As the marker is moved up and down, back and forth and to and fro the angle at which pressure is exerted, on the nib, is changed and this can weaken, warp and destroy the nib. To resolve or lessen this problem many markers are made with springs helping to absorb the pressure of using the markers and/or a tube like casing is used to support the nib.

Rubber stamps have the ability to transfer complex images quickly and in a repeatable fashion. Rubber stamps have been shaped into cylinders and when run across a material can create long repeating decorations.

Many cutting tools are available. They come in all shapes and sizes. Some use stationary blades, some use moving blades and some use blades-that swivel to allow their cutting direction to be controlled. These devices can be used to create precision cuts, however, precision cutting using these devices, by its nature, is a tedious and difficult task. The task of cutting is extremely difficult when it must be coordinated with an existing design. The user not only needs to make sure all their cuts are done in a fashion that gives a pleasing appearance they too must work to make sure they cut close enough to the existing design so as to remove all surrounding non-design material while at the same time working to avoid removing any of the design.

Present technologies do not directly address the need to cooperatively decorate and cut either in a freeform fashion or when using a template. A need has thus arisen for a device that allows a user to cut, decorate and/or to cooperatively cut and decorate either independently or simultaneously with the same device.

Another deficiency with present markers is seen in the damage caused to their nib by the pressures applied to them during use. A need has arisen for a marker with a supported nib. This extra support is in addition to any spring, casing or other support means.

Cutting blades dull as they are used and, depending on their material's composition, can rust or tarnish making them dull. A need has arisen for a cutting device which keeps the blade coated with ink or decorating material when it is stored and when it is used with the decorating tool.

SUMMARY OF THE INVENTION

A decorating and cutting device includes a housing. A cutting blade and decorating material dispenser are disposed within the housing and are operable to simultaneously dispense decorating material and cut a target material.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DETAILED DESCRIPTION OF THE PREFERRED EMBODIMENTS

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
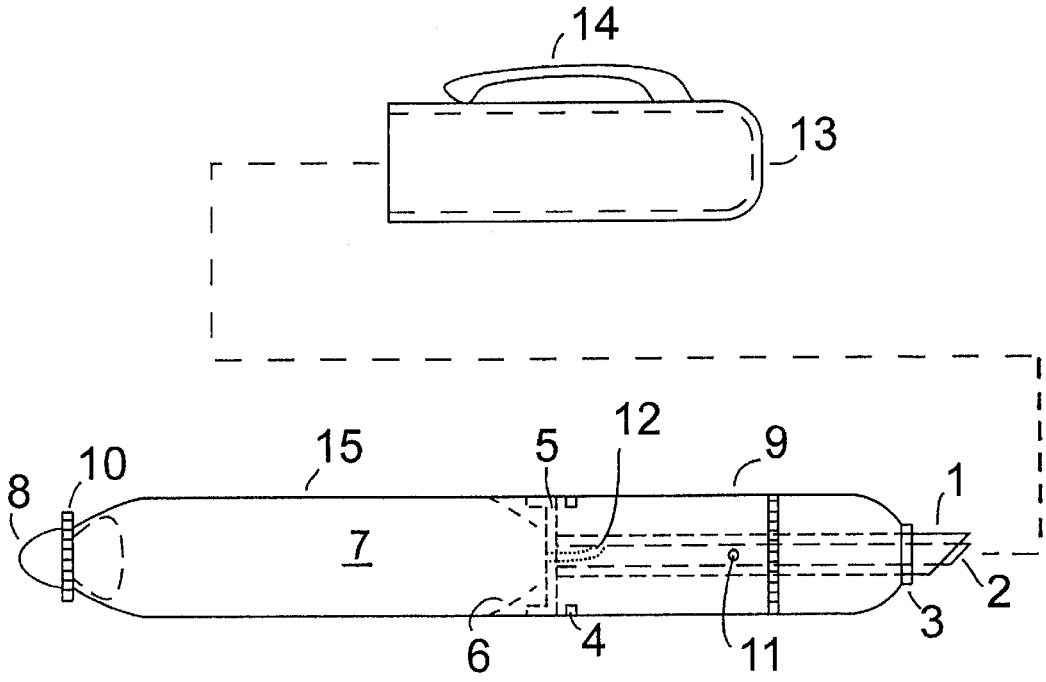
FIG. 1. is an exploded side view of the stationary spring tensioned cutting edge and decorating device of the present invention.

FIG. 1 shows an embodiment of the present invention that uses a stationary blade and decorating material dispenser or nib in a pen shaped device, which includes a cap and can be used as a normal marking device is used. The decorating material dispenser or nib 1 wicks ink, or other decorating material, from the decorating material storage reservoir 7, via the decorating material feed duct 12. The nib 1 is attached to the cutting assembly 2 and also at the cutting assembly base 5 using, for example, screws, tacks, adhesive, or pins 11 or simply a tight fit and a shape designed to discourage any pull-away forces. The decorating nib 1 and cutting assembly 2 are held in place by the cushion and retaining member 6 and the nib and cutting assembly stop blocks 4. The cutting assembly base 5 is tensioned in place by force from the cushion and retaining member 6. The cushion and retaining member 6 allows the cutting assembly 2 and nib 1 to be biased in a stationary position and also to give, flex and move slightly, when force is exerted during use. This will prolong blade and nib life and also protect them from shock. Member 6 also gives the device a softer feel and makes it easier to accommodate rough surfaces. The cushion and retaining member 6 also operates with a valve system. One embodiment has the valve attached to and working with the nib and cutter assembly base 5.

The decorating material reservoir 7 can simple be an empty reservoir or it can be filled with a material that is conducive to storing the decorating materials as anyone skilled in the art will know. The closing cap 8 keeps the decorating material sealed inside the main case 15.

Decorating material as used herein is any type of material that can be applied to a target material or surface for any useful purpose. Decorating material includes, for example, but is not limited to ink, dye, glue, lacquer, etching solution, oil, stain, colored wax, glitter and glue, colored glue, clear coat or any other material that might have some useful benefits. A target material includes, for example, paper, cloth, leather, cardboard and the like, or any other material that might receive some useful benefits.

Other features of the device of FIG. 1 include a finger grip 9 designed to make the device comfortable to use. A template trace edge 3 designed to make it easy to use the device with a template. A color indicator 10 designed to show the color, type and surface finish, and other characteristics, of the decorating material and or blade.

A user uses the device of FIG. 1 like a regular pen type marking device and instead of simply marking they mark and cut simultaneously.

Figure 2:
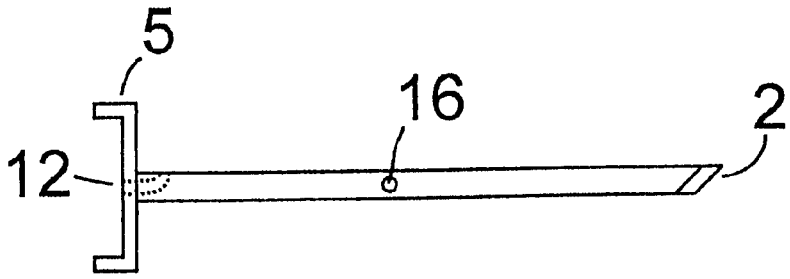
FIG. 2. is a side view of the cutting blade shown in FIG. 1.

FIG. 2 shows a side view of the cutting assembly with cutting edge 2, base 5, hole 16 for attachment pin 11 and decorating material duct 12.

Figure 3:
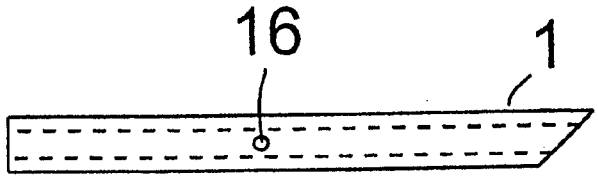
FIG. 3. is a side view of the nib with opening to accept the cutting blade shown in FIG. 1.

FIG. 3 shows the nib 1 with its hole 16 for attachment pin 11 and opening through its center to accommodate the cutting assembly.

Figure 4:
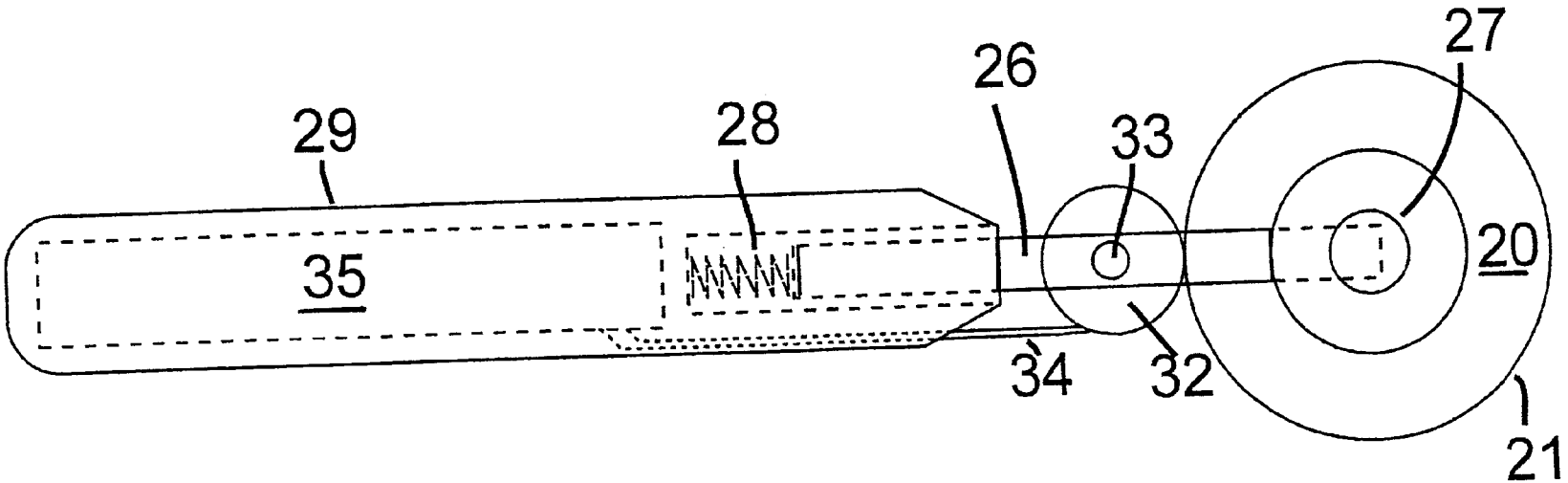
FIG. 4. is a side view of a rotating cutter and decorating device of the present invention.

FIG. 4 shows a side view of an additional embodiment of the invention using a rotating cutter assembly, rotating decorating assembly with decorating material supply pad. The device uses a rotating blade, with flat or shaped cutting edge, in cooperation with a rotating decorating device.

This embodiment stores the decorating material in the decorating material storage vessel 35 and feeds it to the decorating material supply pad 32 via the decorating material supply 34 that can use capillary, wicking or any other suitable transmission action.

A user uses the device by holding the handle 29 and pushing the decorating disk 20 and cutting disk 21 on a target object and then applying force in the direction they wish to cut and decorate.

The spring 28 gives the device a softer feel and more control over the pressure that is applied.

Figure 5:
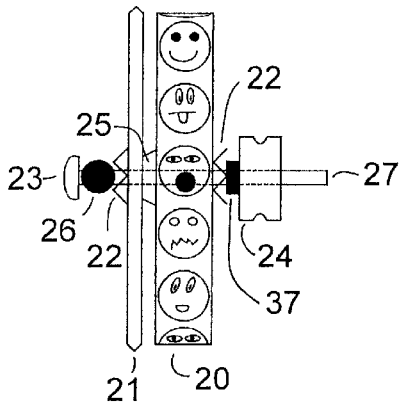
FIG. 5. is a bottom view of device shown in FIG. 4.

FIG. 5 shows a bottom view of the device shown in FIG. 4. Screw head 23 acts as one end of the shaft that holds the decorating disk 20, guide shaft 26, spacing washer 25, wave spring 22 and cutting disk 21 assembly. The other end is closed by a locking nut 24 that is used to close the end of the shaft and also acts as a tensioning adjustment. This embodiment shows a flat round blade that will produce a straight edge cut. It is important to note that a shaped blade edge is used, with or without spacers, to make cuts of varying shapes at varying distances from the decoration. The device is assembled with the guide shaft 26, and other components, arranged differently to create different effects and different feels when, being used. As one example, the device is assembled with the shaft on the right side of the cutting and decorating disks to allow easier use by a left handed person. Another example is to assemble a shaped cutting disk on the left side of the guide shaft 26 with a 2 mm sized spacer 37 and the cutting disk on the right side of the guide shaft 26 with a 3 mm sized spacer 37. This would allow creation of a shaped cut edge with the design being made 5 mm plus the size of the guide shaft away. Another configuration includes using a nut, acting as a spacer, with the blade and guide shaft held securely and a decorating disk held loosely on the other side. This configuration would make consistent cuts with inconsistent and random designs that might be very appealing when interested in creating one of a kind, natural patters or security bands that need to be difficult to duplicate.

Figure 6:
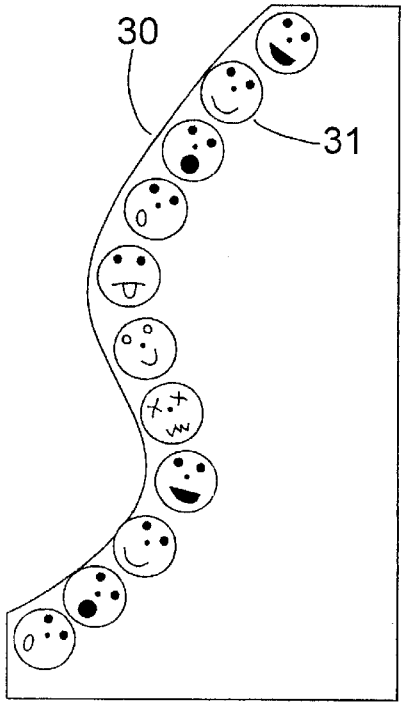
FIG. 6. is a top view of a cut and decorated edge.

FIG. 6 shows a cut edge with a design on the right of it, as one might see, created by a device as shown in FIG. 4.

Figure 7:
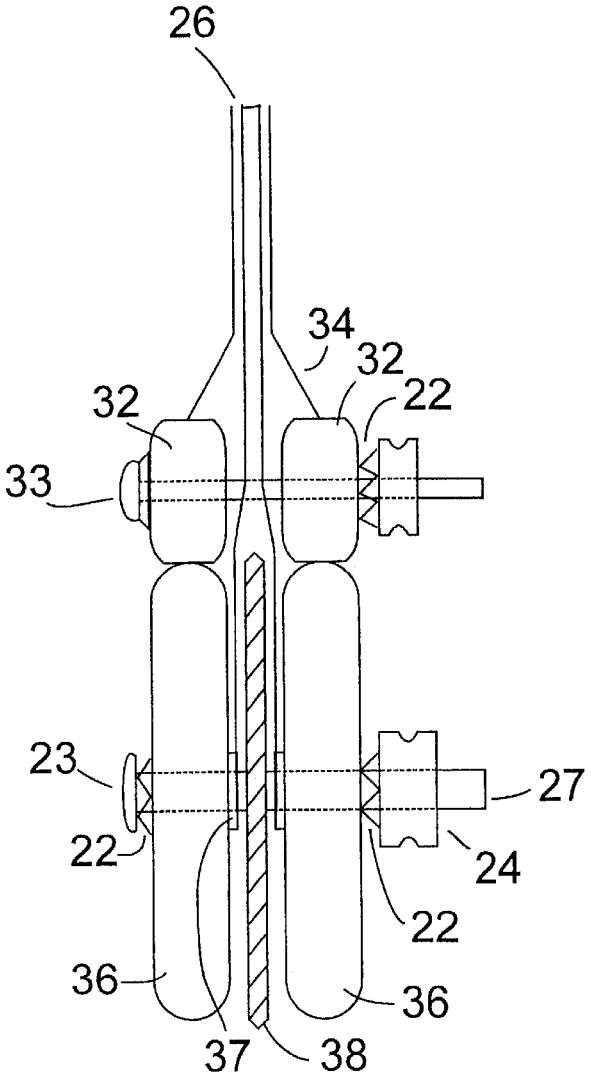
FIG. 7. is a front view of a dual decorating wheel device with a single shaped cutting wheel and sized spacers.

FIG. 7 shows an embodiment of the device that uses multiple decorating wheels 36 and a single cutter 38. In this embodiment two different decorating material supply pads 32 are used, one to supply each decorating wheel 36, but each using different decorating materials. This allows the device to color each side of the cut with different, or same, material. In this configuration the main cutting blade 38 is sandwiched between two legs of a guide shaft 26. The main cutting wheel 38 shown is a perforation wheel, as shown by the diagonal lines, so instead of making a full cut wheel 38 makes a perforation that can be later hand torn to the shape with the decoration on each side. Cutting wheel 38 can be interchanged to create different effects and different types of cuts or other operations like embossing, engraving, punching or any other desirable outcome. The screw head 23 maintains the assemblies on shaft 26. The wave washer 22 allows the nut and tension adjustment 24 to remove slack. from the assembly, which allows it to turn as freely or as tightly as the material being cut and decorated and the user needs and wants it to. The support screw 27 is sized to accept at least one cutting wheel 38 and at least one decorating wheel 36. One or more cutting wheels 38 and one or more decorating wheels 36 and one or more sized spacers are assembled in varying configurations that perform various tasks of decorating and cutting. This allows these devices to make cut and decorated edges and also strips cut on both sides with decorations down the center. It can create one to many strips each with cut edges and or perforations and designs all at the same time. The decorating material supply 34 draws decorating material from the decorating material storage vessel 35. If desired the decorating material supply 34 can be discarded and instead the decorating material supply pad 32 can store the decorating material. Replacing the decorating material supply pad 32 will replenish the decorating material supply. This configuration also allows for quick decorating material changes.

Figure 8:
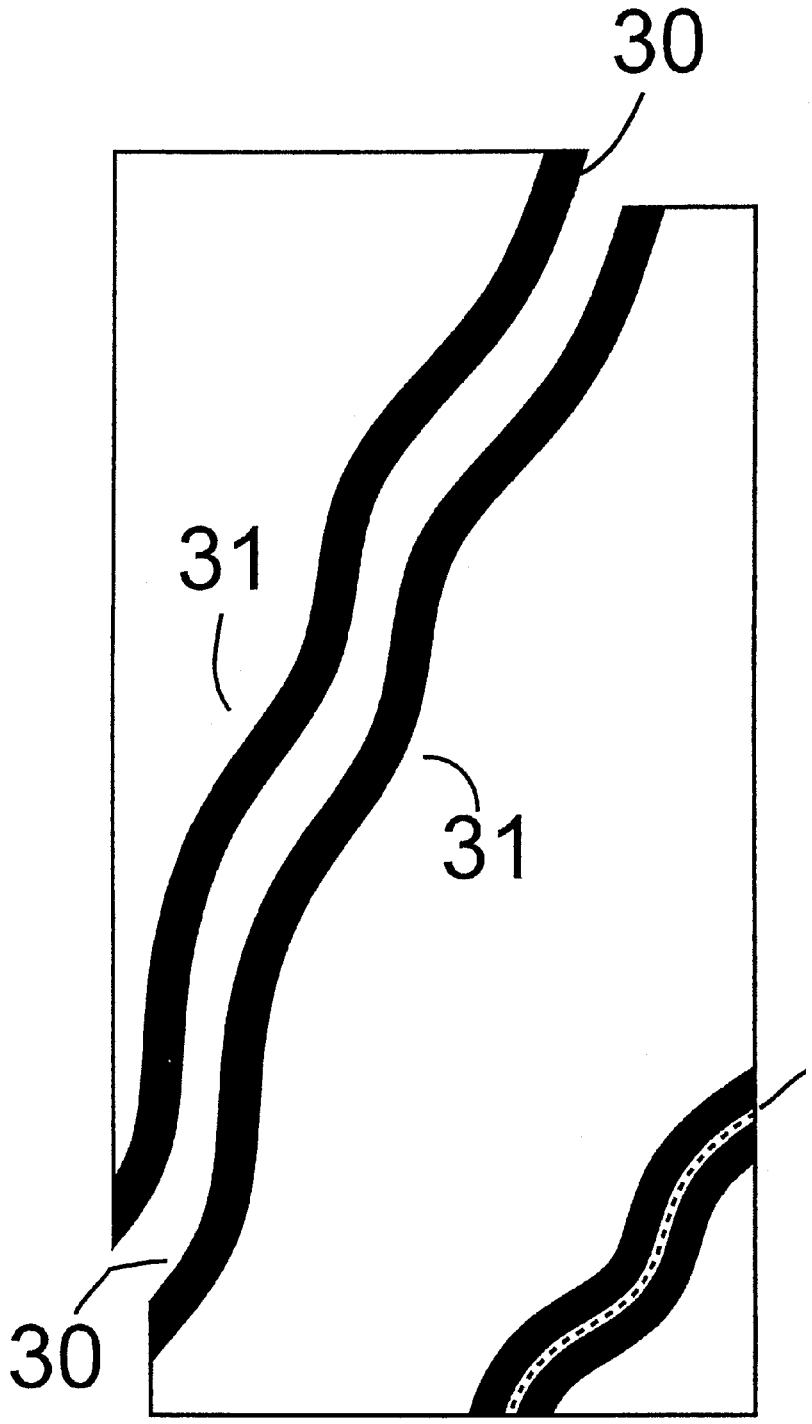
FIG. 8. is a top view of a cut and decorated edge using the dual decorating wheels and a single round flat cutting wheel with the device of FIG. 7 and a perforating wheel with the device of FIG. 7.

FIG. 8 shows a target material, like a sheet of paper or cloth, with edges created by the device of FIG. 7. The single cut is surrounded by two decorated edges. The decoration is almost touching the cut edge because a small spacer 37 is used to separate the blade 38 from the decorating wheel 36. The cut edges shown in FIG. 8 are made with a straight flat cutting wheel like the one shown in FIG. 5. The decorated perforation 39 is created from a device configured with a perforation blade and two decorating wheels.

Figure 9:
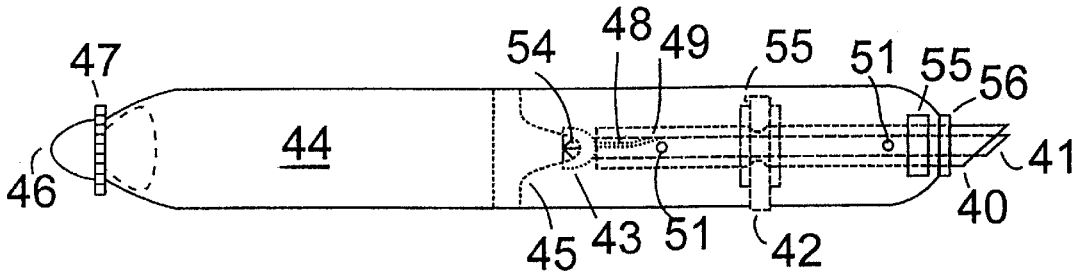
FIG. 9. is a side view of a swivel blade cutting and decorating device of the present invention.

FIG. 9 shows an embodiment of the present invention that uses a swiveling blade nib assembly to allow easy creation of curved cuts and designs. The cutting blade 41 is attached to the decorating nib 40 and the swivel mount 55 to create an assemble that can rotate about the cutting edge of the blade. The blade nib end support 43 interfaces with the decorating material valve 54 that is attached to the blade nib support spring 45. When pressure is applied to the blade 41 and nib 40 the decorating material valve 54 opens to provide decorating material to the nib 40. Decorating material valves are generally known to those skilled in the art. Valve 54 includes a rounded and cut through piece of material that will keep the decorating material in the decorating material storage area 44 until pressure is applied then it will leak, at the seams of the cuts thus supplying decorating material. The decorating material that is released is drawn by the decorating material feed 48 and then through the decorating material exit opening 49 to the nib. Wicking or capillary action can draw the decorating material to the tip of the nib and the nib will draw the material to its end. The rounded top of the decorating material valve acts as a bearing for the blade nib end support 43 and helps lower friction to increase ease of swivel action. The blade and nib assembly is held in place by the blade nib retaining lock 42. The blade nib retaining lock 42 is moveable far enough away from the blade nib assemble to allow it to be removed and replaced with a new or different blade nib assemble. This will allow a user to change the blade and nib either to replace a well-worn blade and/or nib or to use one with different characteristics like thickness or shape of nib or size or type of cutter.

Figure 10:
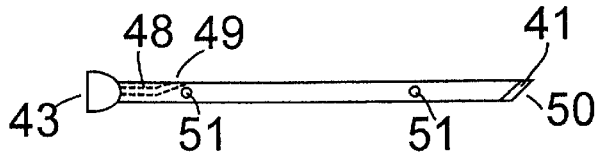
FIG. 10. is a side view of a cutting blade with decorating material duct of FIG. 9.

FIG. 10 shows the blade with its end support 43, decorating material feed 48, decorating material exit opening 49, blade nib attachment means 51 and cutting edge 50. The use of each of these is outlined in the embodiment above.

Figure 11A:
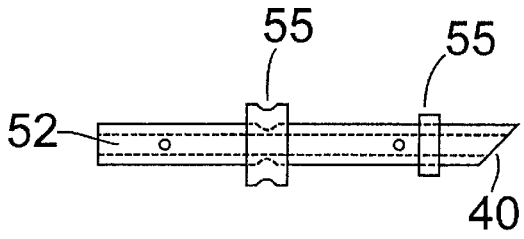
FIGS. 11*a*. and 11*b*. are side and front views of a decorating nib of FIG. 9.
Figure 11B:
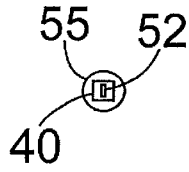

FIGS. 11*a*. and 11*b*. show the nib 40 with swivel mounts 55 and duct 52 for blade. Swivel mount 55 is used to attach the nib and blade in a manner that will allow them to be firmly pressed to the target material yet still swivel to cut and decorate curves.

Figure 12A:
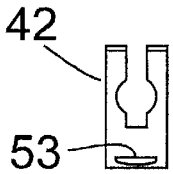
FIGS. 12*a*. and 12*b*. are top and side views of the blade nib lock of FIG. 9.
Figure 12B:
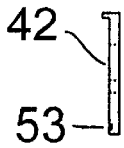

FIGS. 12*a*. and 12*b*. show the blade nib retaining lock 42 details. It has a fingernail pull recess 53, and entry slot and a cylindrical cutout in the center that supports and snaps onto the center swivel mount attached to the blade nib assembly.

Figure 13A:
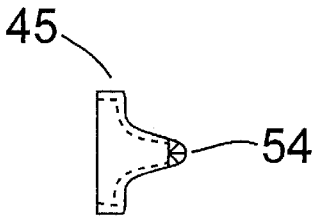
FIGS. 13*a* and 13*b*. are side and bottom views of the blade nib support and decorating material valve of FIG. 9.
Figure 13B:
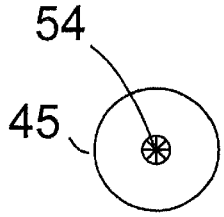

FIGS. 13*a*. and 13*b*. show the blade nib support spring 45. This is made of a springy material that also acts as a barrier holding in the decorating material in the decorating material storage area 44. When the blade nib support spring 45 is pressed, by the force of using the blade and nib, the slits in the decorating material valve open enough to allow decorating material to pass-from storage to the decorating material feed 48.

Figure 14B:
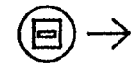
FIGS. 14*a*., 14*b*., 14*c*. and 14*d*. are top views showing the blade and decorating nib of FIG. 9 in various positions.
Figure 14C:
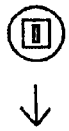
Figure 14D:
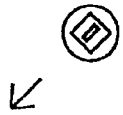
Figure 14A:
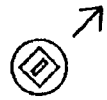

FIGS. 14*a*.–14*d*. show how the blade and nib will swivel in the direction of the desired cutting and decorating as the user uses the device.

Figure 15:
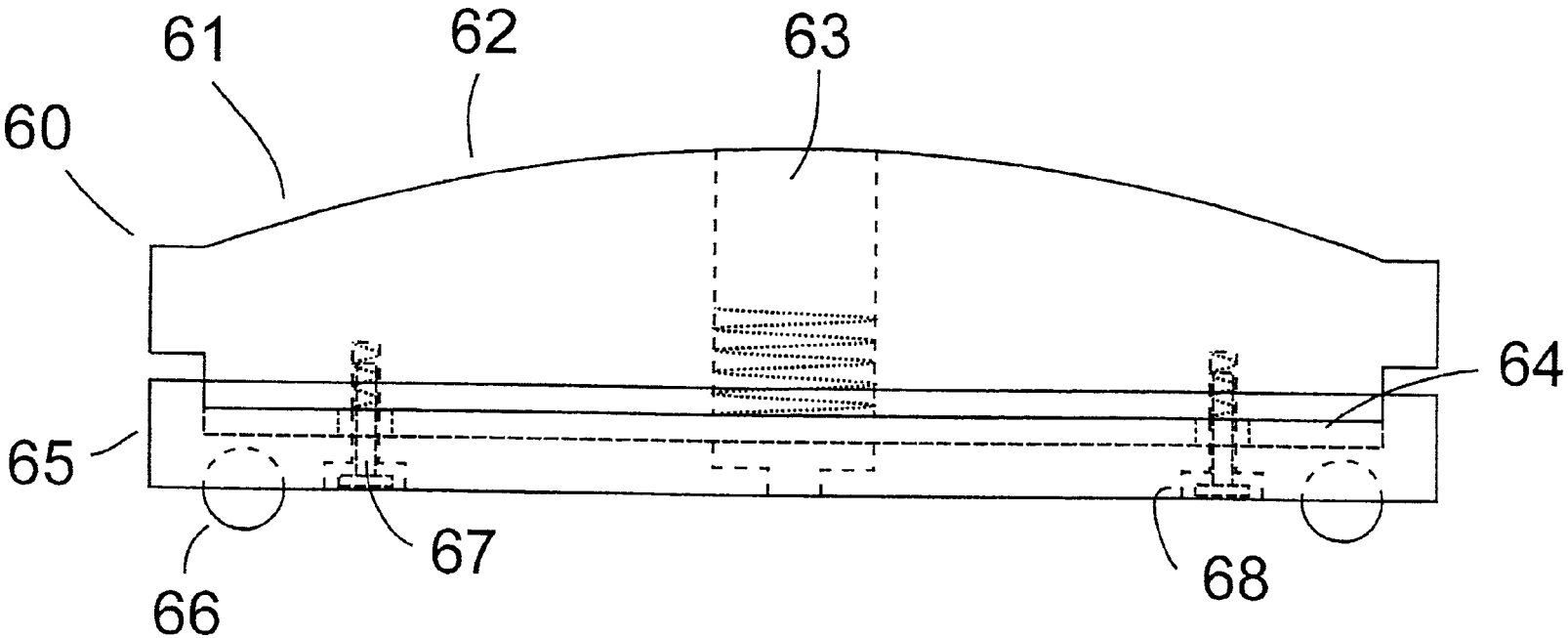
FIG. 15. is a side view of an additional embodiment of the present invention.
Figure 20:
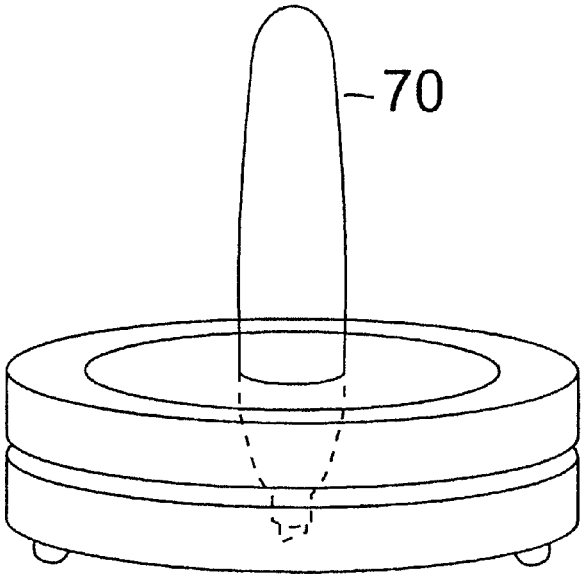
FIG. 20. is a perspective view showing the attachment of FIG. 15. and a cutting decorating device.

FIG. 15 shows an attachment that allows a swivel cutting and decorating device, like the one described above in FIG. 9, to be more easily controlled. A swivel cutting and/or decorating device is attached to the device as shown in FIG. 20. The user inserts the pen, cutting implement, or a cutting and decorating device into the pen and cutter opening 63 and screws it into the threaded pen attachment location 69. This attachment can also be made by friction, a pin or other forms of attachment. Now the user can hold the edges of the device, with one to many, fingers on the finger grip 61. The user can see the target material and the cutting and decorating tool through the magnifying lens 62. By pushing down on the finger grip 61 the silicon like see through spring 64, or a real spring, compresses allowing the blade and/or nib to contact the target material. Moving the device with the top element pressed down will cause the decoration and/or cutting to take place at the point the decorating and/or cutting assembly contacts the target material as seen through the lens. Rollers 66 assist the device moving across the target material and also keep the, blade and nib from contacting the target material until engaged to do so.

Figure 16:
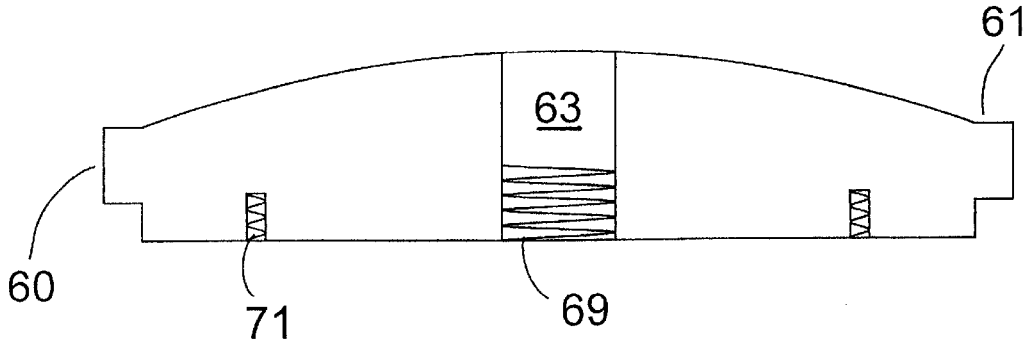
FIG. 16. is a side view of the top component of the device shown in FIG. 15.

FIG. 16 shows the top assembly 60 of the device. Its center opening 63 firmly holds the decorating and cutting device, which can have screw threads that mesh with those inside the center opening 63. The assembly threaded opening 71 allows the top assembly 60 to be attached to the bottom assembly 65 via a screw passed from the bottom assembly 65 through the spring 64 and finally screwing into the top assembly 60.

Figure 17:
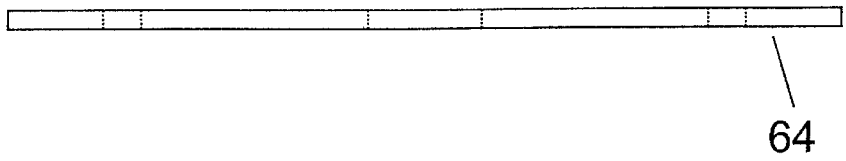
FIG. 17. is a side view of a piece of see through compressible material of FIG. 15.

FIG. 17 shows one embodiment of a spring 64 that uses a piece of compressible clear material, such as, for example, gel or silicon, with openings molded or cut into it to allow it to match the openings in the top and bottom assemblies. The spring 64 acts as a spring and also allows the target material to be more viewable.

Figure 18:
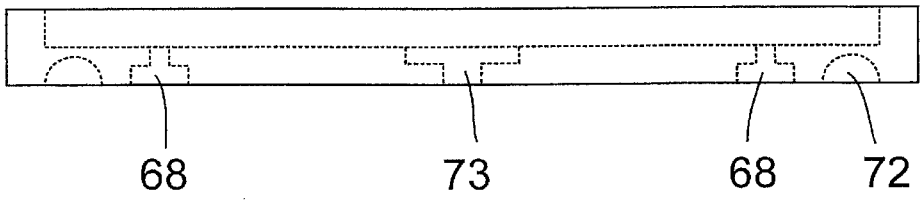
FIG. 18. is a side view of the bottom component of the device shown in FIG. 15.

FIG. 18 is the bottom assembly 65. The pass through 73 allows the pen to freely move up and down as the pressure on the top assembly 60 dictates it should. It also has a stop on it to keep the pen and or cutting device from slipping out the bottom of the entire device. Roller snap-in recesses 72 are designed to allow a ball bearing type roller to be snapped in place and then to freely turn to assist in rolling the device across a target material. Assembly screw recesses 68 allow a screw to connect the top and bottom assemblies, along with their integrated components, together.

Figure 19:
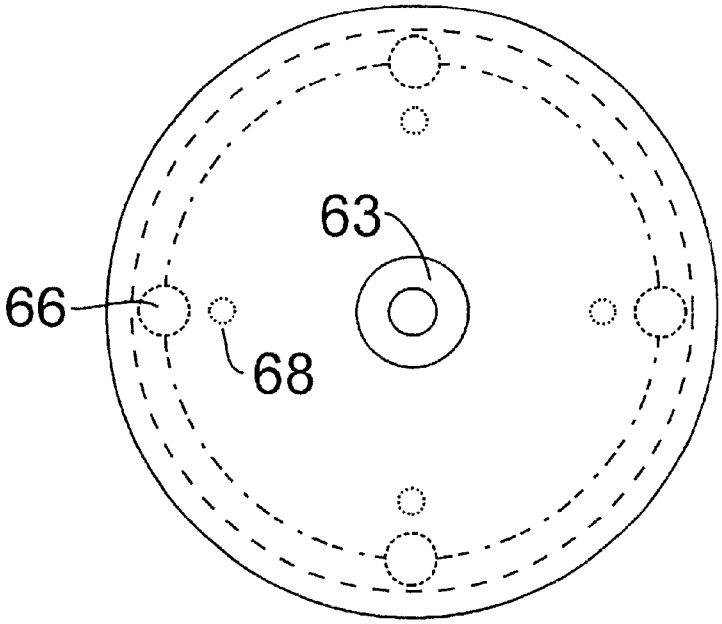
FIG. 19 is a top view of the device shown in FIG. 15.

FIG. 19 is a top view showing a device and one possible layout of rollers 66 and assembly screw recesses 68.

FIG. 20 is an orthogonal view of one embodiment of the device showing the pen and or cutting device in the center.

The shape of the entire device can be any shape. A circle was selected as an example and should not be considered limiting. Hand conforming tear drop shapes, square, rectangle, oval, shapes of company logos and any other shape that would be desirable could be used.

Figure 21:
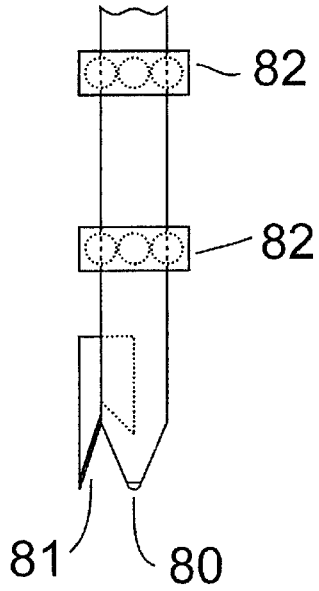
FIG. 21. is a side view of a pull blade and ball bearing system with ball bearings as support and to facilitate rotation and swiveling and or for applying decorating material in accordance with the present invention.

FIGS. 21. and 24. show a modified blade roller assembly that uses the roller to distribute decorating material while cutting or uses the roller simply to assist in cutting or uses the roller to distribute a material or solution that performs a task or assists in cutting without decorating or applying any material. This embodiment of the invention uses a pull cutting blade 81 with a roller 80 set ahead of it. The roller 80 scores a path in front of the blade 81 assisting the blade in cutting along a specific path. The roller 80 also allows a user to make more accurate and intricate turns and curves. In addition to other benefits the roller 80 provides a cushion protecting the cutting blade and or limits the cutter's depth protecting beneath the material by pushing the cutter above the material. Ball bearings 82 are used to support the device in a manner that allows it to swivel freely.

Figure 22:
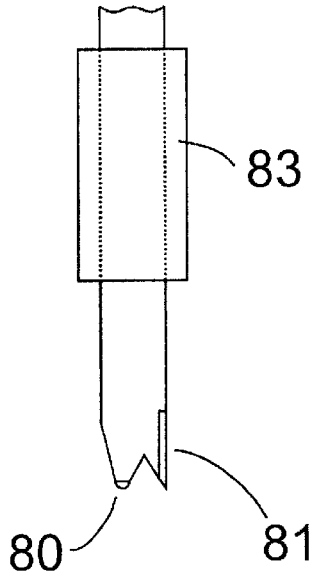
FIG. 22. is a side view of a push blade and ball bearing system with low friction sleeve as support and to facilitate rotation and swiveling and or for applying decorating material in accordance with the present invention.

FIGS. 22. and 25. show a modified blade roller assembly that uses the roller to distribute decorating material while cutting or uses the roller simply to assist in cutting or uses the roller to distribute a material or solution that performs a task or assists in cutting without decorating or applying any material. This embodiment of the invention uses a push cutting blade 81 with a roller 80 set behind it. The roller 80 assists the blade 81 in rolling across the target material. The roller 80 also allows a user to make more accurate and intricate turns and curves. In addition to other benefits the roller 80 also provides a cushion protecting the cutting blade and limits the cutter's depth protecting beneath the material by maintaining the cutter above the material. A low resistance sleeve 83 is used to hold the shaft in place in a manner that allows it to swivel freely.

Figure 23:
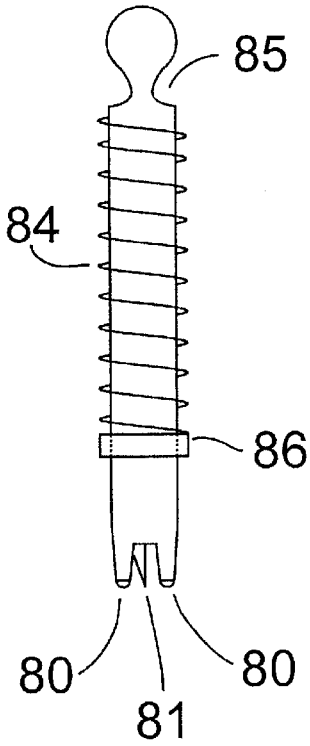
FIG. 23. is a side view of a push blade with multiple ball bearings surrounding it to facilitate rotating, swiveling and cutting in accordance with the present invention.
Figure 24:
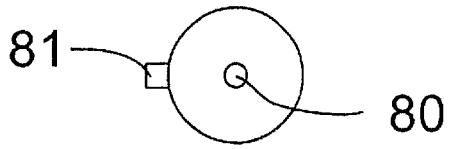
FIG. 24; is a bottom view of the pull blade of FIG. 21.
Figure 25:
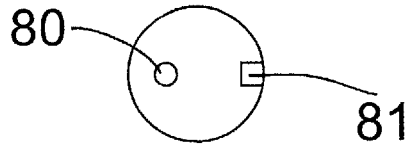
FIG. 25. is a bottom view of the push blade of FIG. 22.
Figure 26:
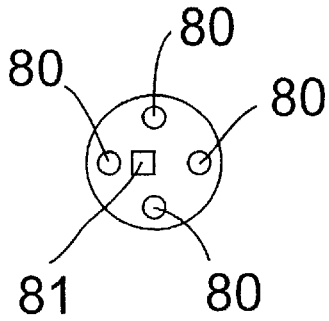
FIG. 26. is a bottom view of the multiple ball bearings surrounded blade of FIG. 23.

FIGS. 23. and 26. show a modified blade roller assembly that uses the roller to distribute decorating material while cutting or use the roller simply to assist in cutting or use the roller to distribute a material or solution that performs a task or assists in cutting without decorating or applying any material. This embodiment of the invention uses a centrally located cutting blade 81 with, more than one, roller 80 set near it. The rollers 80 assist the blade 81 in rolling across the target material. The rollers 80 also allow a user to make more accurate and intricate turns, cuts and curves. In addition to other benefits the rollers 80 also provide a cushion protecting the cutting blade and limiting the cutter's depth protecting beneath the material by maintaining the cutter above the material. A low resistance sleeve 84 shaped and acting like a spring is used to hold the shaft in place in a manner that allows it to swivel freely. The ball end and concave low resistance mount means 85 allows the device to be attached to a receptacle that will hold it firmly in place and allow it to swivel.

In the embodiments shown in FIGS. 21, 22, 23, 24, 25 and 26 it is important to note that the blade can be made to be higher or lower than the rollers and/or at different angles in relation to each other to provide different advantages when cutting different materials. Separate adjustments are added to allow manual adjustment to be made allowing the user to adjust the orientation and/or height of the roller, or rollers, in reference to the blade or blades. These devices may be made, for example, with one or more blades and one or more rollers in any orientation or configuration that is found to be advantageous and/or as the needs of the task require or would be assisted by.

Figure 27:
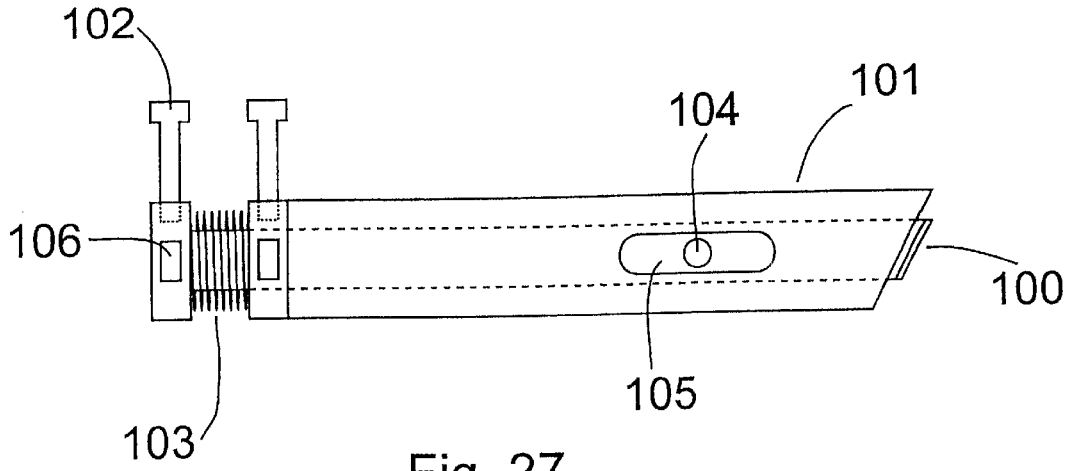
FIG. 27. is a side view of a retractable blade nib assembly in the cut and decorate position in accordance with the present invention.
Figure 28:
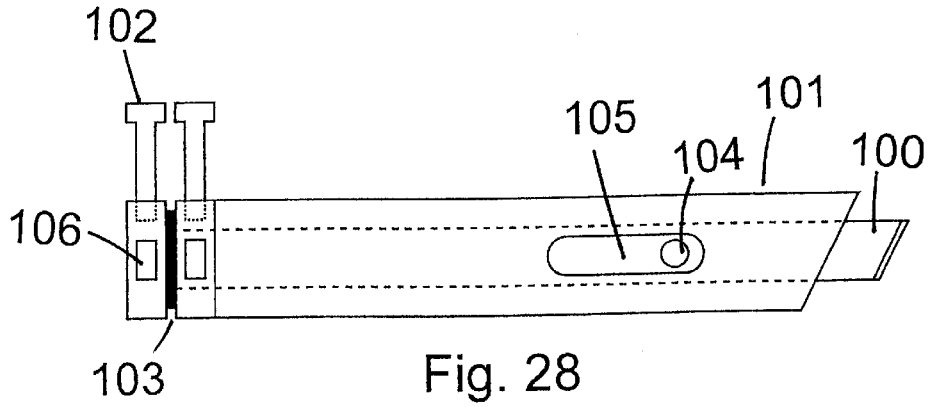
FIG. 28. is a side view of the blade nib assembly of FIG. 27. in the cut only position.
Figure 29:
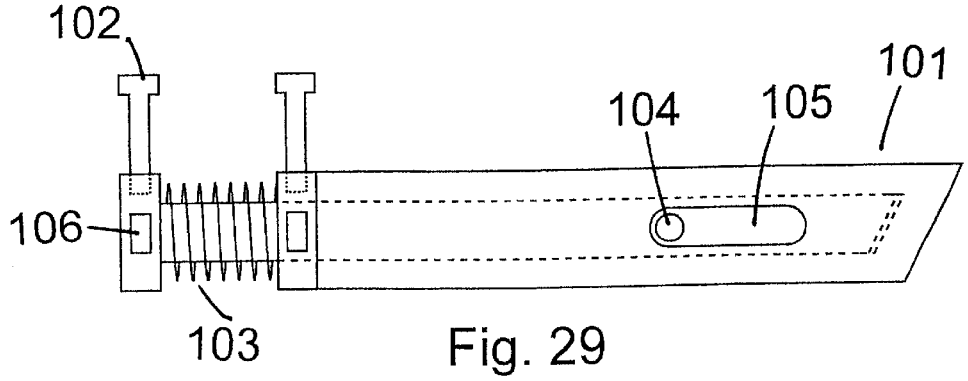
FIG. 29. is a side view of the blade nib assembly of FIG. 27. in the color only position.

FIGS. 27, 28 and 29 show a blade and nib configuration that allows the user to set the tool so it will exhibit different characteristics. By moving the blade and or nib a user can change the way the tool works and acts. For example if the user moves the nib all the way out, toward the target material, and then moves the blade toward the inside of the device, further away from the target material, the user could set the blade so it only scores, instead of cuts through, the target material while it is decorating the target material. If the user moves the blade all the way into the device the device will still decorate the target material but will not score, mark or cut it. By moving the nib slightly into the device and the blade all the way out the user could cut the target material and only lightly mark it or move it further in and not mark it at all. Different combinations of relationships between the blade and nib and their performance on different target material can produce different useful results. This makes this tool quite useful and able to adapt to different target material and to perform many useful functions.

The following descriptions show some of the many ways the relationship between the protrusion of the blade and nib from or into the device and the relationship between the blade and nib can be used to create some of the many combinations of features this device can perform. These drawings are not meant to be limiting but simply meant to show examples of several of the almost infinite possible combinations of the blade, nib and device relationship.

FIG. 27 shows the blade 100 and nib 101 in a position that allows the user to cut and decorate simultaneously. The handles 102 allow the user to engage or disengage the blade and/or nib. A spring 103 helps to tension the blade and nib and the incremental movement position fins 106 work with ridges inside the case to cause the blade and nib to click as they are moved and also biases them to stay in the position they are set in. By placing more ridges inside the case the user has more ability to determine the incremental distance in the relationship between the blade and the nib and the blade and nib's protrusion or insertion into the device. The fin 106 works similar to a locking blade in a cable tie and the ridges are similar to the ridges in the cable tie's main strip. In, a cable tie the locking blade and ridges allow for movement in only one direction but in this device the movement is allowed in both directions.

FIG. 28 shows the blade 100 and nib 101 in a position that allows the user to cut without decorating. The handles 102 allow the user to engage or disengage the blade and/or nib. Its other features are similar to the description of FIG. 27 above.

FIG. 29 shows the blade 100 and nib 101 in a position that allows the user to decorate without cutting. The handles 102 allow the user to engage or disengage the blade and/or nib. Its other features are similar to the description of FIG. 27 above.

The user, because of the almost infinite free movement between the blade 100 and nib 101, can select any position for the blade 100 and nib 101. This allows the user to take advantage of the different possibilities created by changing the orientation of the blade to the nib, the blade to the device, the nib to the blade, the nib to the device and the combination of the blade and nib's orientation to the device. Moving the blade and nib all the way into the device closes the device for storage, transportation, and protects the blade and nib and items they come in contact with.

Figure 30:
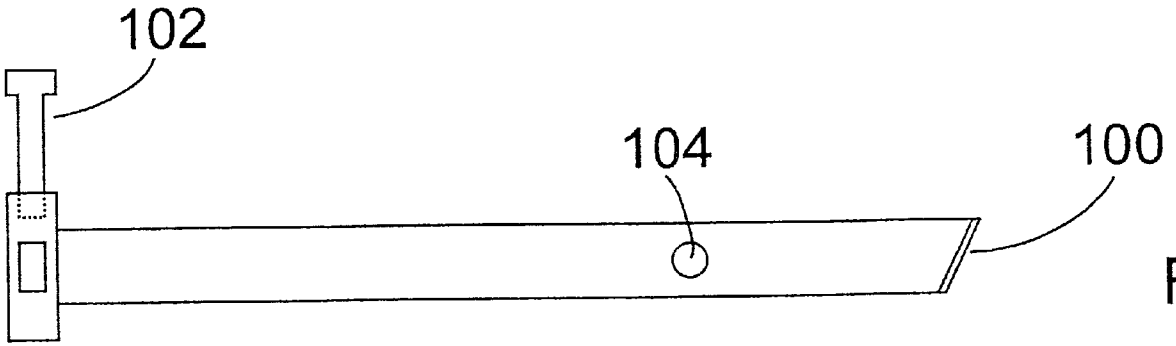
FIG. 30. is a side view of a blade assembly of FIG. 27.

FIG. 30 shows a side view of the blade 100 assembly.

Figure 31:
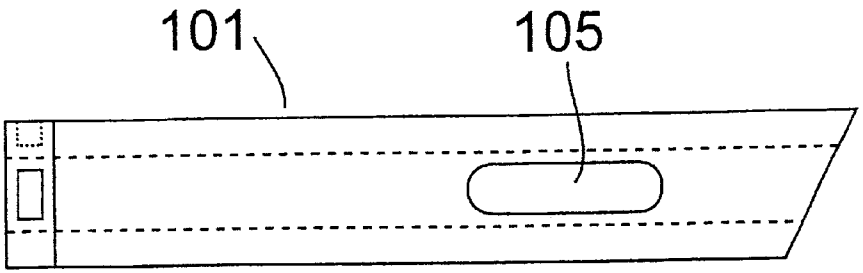
FIG. 31. is a side view of a decorating nib of FIG. 27.

FIG. 31 shows a side view of the nib 101 assembly.

Figure 32:
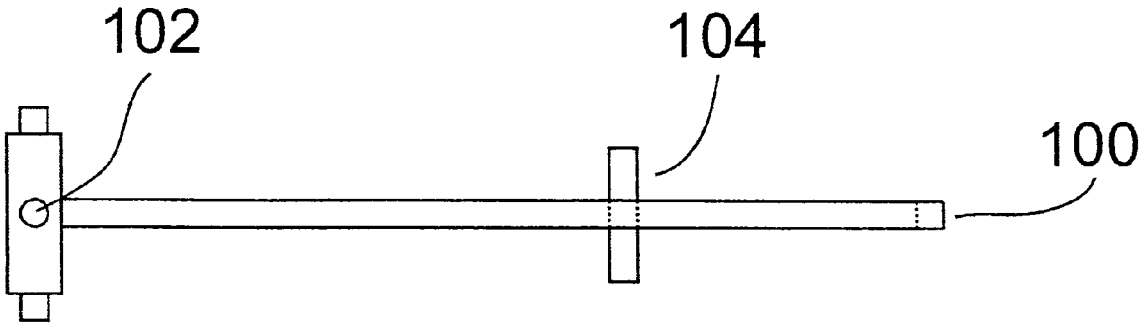
FIG. 32. is a top view of a blade assembly of FIG. 27.

FIG. 32 shows a top view of the blade 100 assembly with a protruding alignment pin to hold the blade and nib in alignment.

Figure 33:
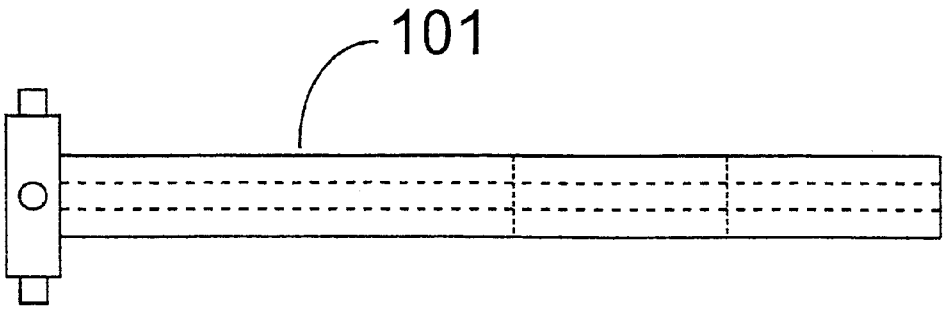
FIG. 33. is a top view of a decorating nib of FIG. 27.

FIG. 33 shows the top view of the nib 101 assembly.

Figure 34A:
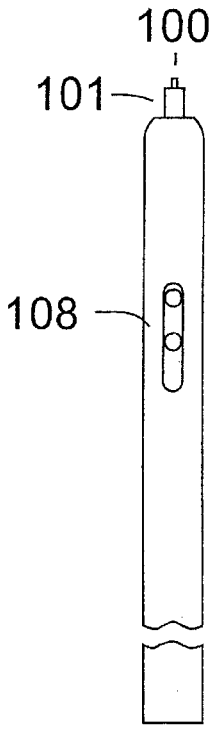
FIG. 34*a*. is a top view of the assembly of FIG. 27. showing the blade and nib handles in a cut and decorate position.
Figure 34B:
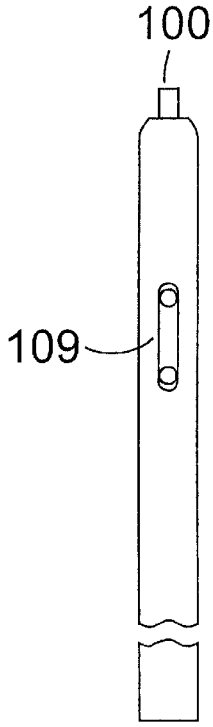
FIG. 34*b*. is a top view of the assembly of FIG. 27. showing the blade and nib handles in a decorate only position.
Figure 34C:
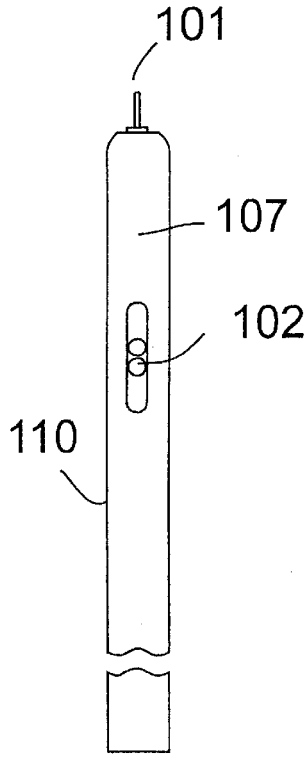
FIG. 34*c*. is a top view of the assembly of FIG. 27. showing the blade and nib handles in a cut only position.

FIGS. 34*a.*, 34*b.* and 34*c.* show three top views of the device with its blade and nib in three of their many possible combinations. FIG. 34*a.* shows how the handles 102 would look, in this embodiment, when they are set for cut and decorate. FIG. 34*b.* shows how the handles would look, in this embodiment, when they are set for decorate only. FIG. 34*c.* shows how the handles would look, in this embodiment, when they are set for cut only.

The blade and nib can be moved in any combination and to orient themselves to each other and the device itself in any manner. Indicator indicia and or pronounced internal ridges and or internal or external stops can be added to the device to allow easy reference for setting the tool. If, for example, we find an optimal setting for a target material, like ⅛ inch thick leather, to be with the blade as far out as possible and the nib to be 1/16 inch further away, toward the device, causing the blade to protrude 1/16 inch beyond the nib. It could be noted on the device, in a visual, auditory, tactile or combination of any or all three methods of indication of this optimal position for the blade and the nib. This allows the user to set the device quickly for the task or material at hand.

Figure 35:
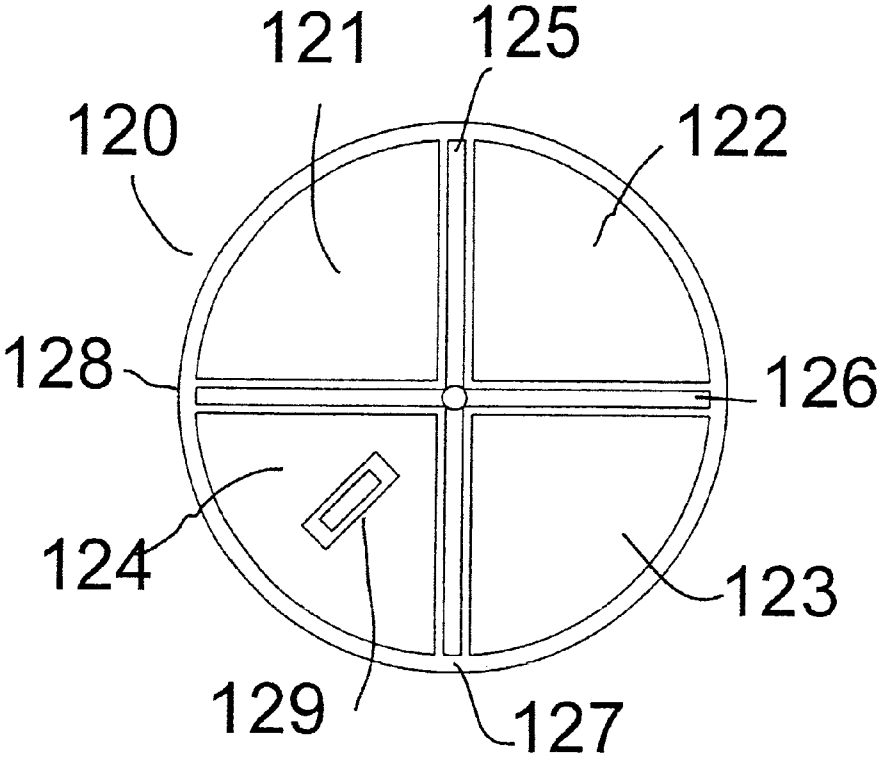
FIG. 35. is a bottom view of a further embodiment of the invention with four decorating surfaces and five cutting surfaces.

FIG. 35 shows a bottom view of an embodiment of a multi-edged decorating and cutting device with three non-cutting colored nibs 121, 122, 123, one colored nib 124 with internal cutter 129, a four faced blade assembly 133 with four cutting edges 125, 126, 127, 128 and a case 120 holding everything. A user can use one cutter with two nibs simultaneously. For example if one orients the first cutting edge 125 directly toward the target material they will also be orienting the first color nib 121 and the second color nib 122 so that when the device is being used the end result will be a cutter with the decorating material from nib 121 on the one side of the cut and decorating material from nib 122 on the other side of the cut with the cut, made by cutting edge 125 toward the center. The user could also orient one of the non-internal cutting nibs 121, 122, 123 toward the target material. This will allow them to apply decorating material without cutting. When the nib 124 with the internal cutter 129 is used it will apply decorating material from itself around the internal cutting blade 129. The nib is used with cutting blades 127 and 128 and associated nibs 123 and 121 respectively to produce results similar to the other nib and without using the internal cutter. This nib is also used with its internal cutter 129 by itself.

Figure 36:
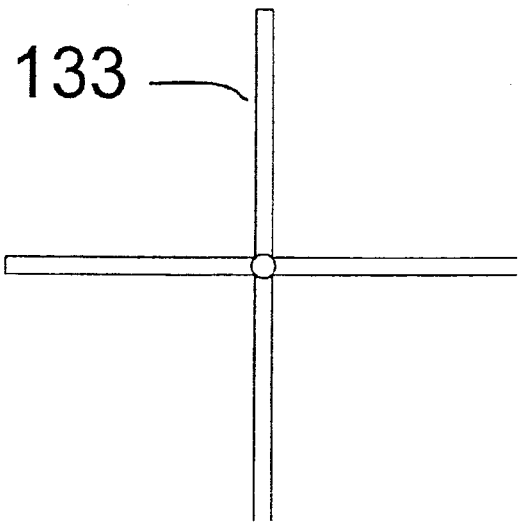
FIG. 36. is a bottom view of the four cutting surfaces of the device of FIG. 35.

FIG. 36 shows a bottom view of the four faced blade assembly 133.

Figure 37:
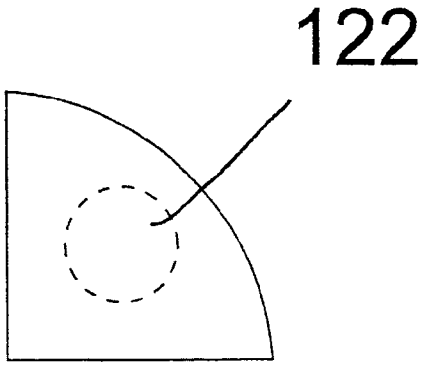
FIG. 37. is a bottom view of a decorating nib of FIG. 35.

FIG. 37 shows a bottom view of the second color nib 122.

Figure 38:
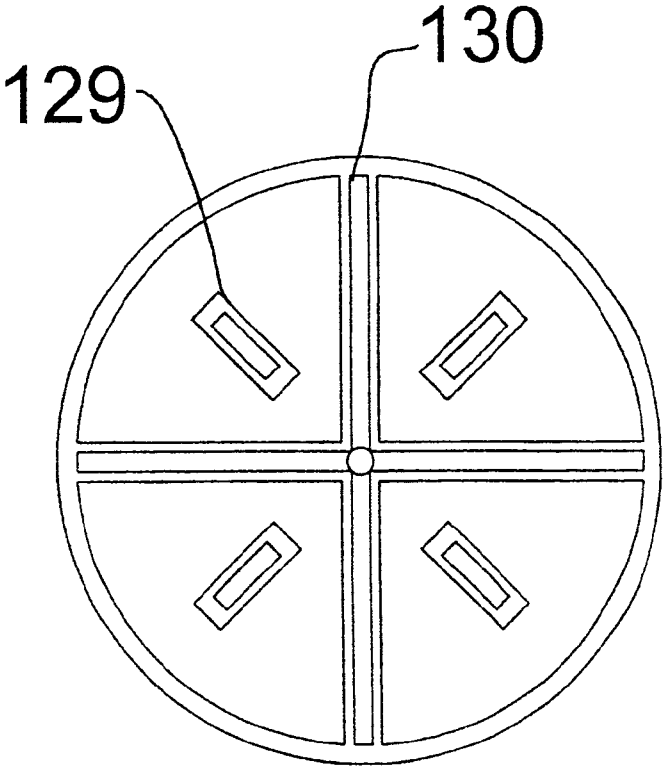
FIG. 38. is a bottom view of a further embodiment of the invention with four decorating nibs and each containing one internal cutter.

FIG. 38 shows a bottom view of an embodiment with four nibs that contain internal cutters 129. A spacer 130 is used to separate each nib, and thus each cutter, a specific distance. This keeps the nib far enough away to avoid contamination from one nib to another. This device can be used to create cuts on which both of its edges have applied the same decorating material or material to perform a specific task. The internal cutter will cut while the nib applies the decorating material around the cut. This device contains four different decorating materials or other types of materials. And the user selects which cutter and material they are applying by rotating the case, in reference to whatever is holding it be it their hand or some other holding device, to orient the correct nib and cutter for the task toward the target material.

Figure 39:
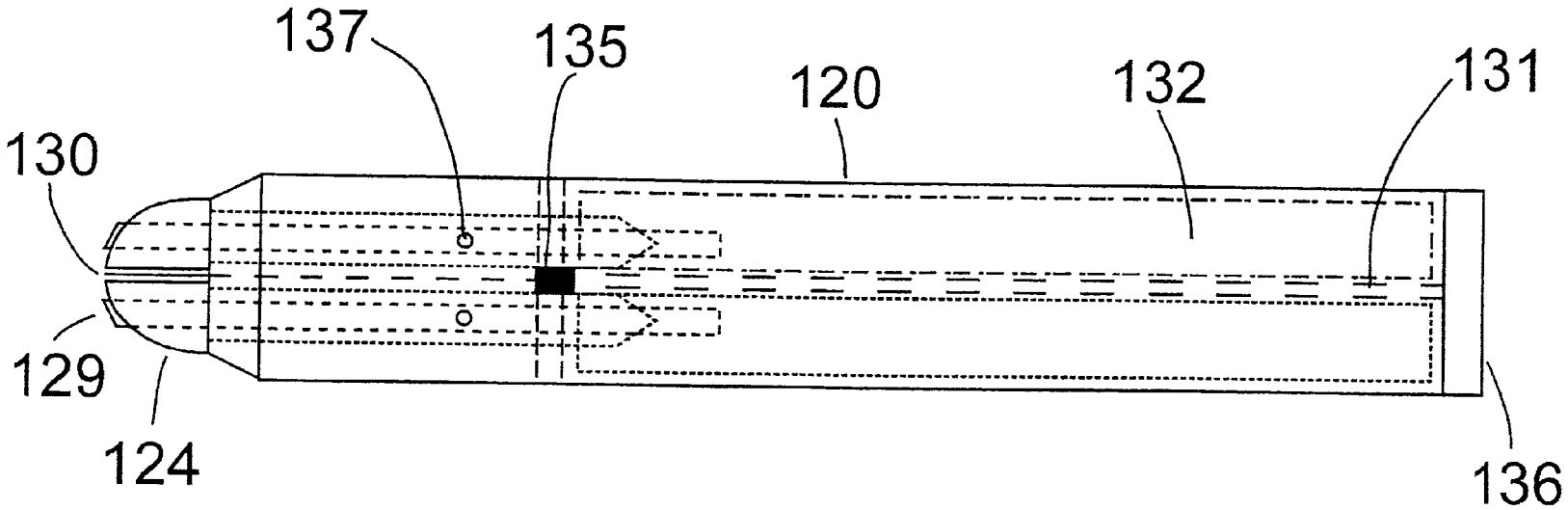
FIG. 39. is a side view of device of FIG. 38.

FIG. 39 shows a side view of the device shown in FIG. 38. This view shows how the internal blades 129 are attached to the nibs 124 via a blade to nib attachment means 137. Also this device uses a sized spacer/separator 130 in place of a four faced blade assembly 133, storage vessels 132 and an end cap 136. This embodiment uses the spacer/separator 130 or a four faced blade assembly 133. The springy connector supporting blade and'spacer/separator 135 attaches the nibs 124 and internal cutters 129 assembly to the device in a manner that allows the blades and nibs to transfer pressure, applied during use, to compress the springy connector supporting blade and spacer/separator 135 to make the device feel responsive during use and to protect the blades and nibs. The decorating material storage separator 131 keeps the materials that feed each individual nib separate to avoid contamination from one decorating material storage vessel 132 to the other.

Figure 40A:
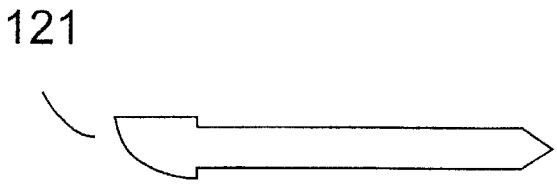
FIGS. 40*a*. and 40*b*. are side and bottom views, respectively, of a drawing nib shown in FIG. 35.
Figure 40B:
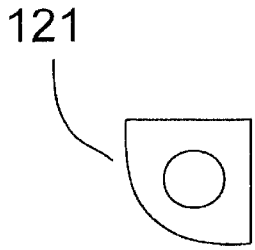

FIGS. 40*a.* and 40*b.* show a side and bottom view of a nib without an internal cutter.

Figure 41A:
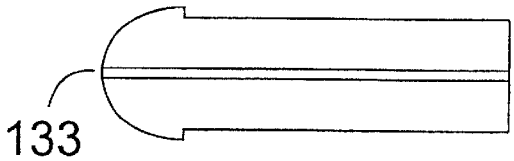
FIGS. 41*a*. and 41*b*. are side and top views, respectively, of a four-faced blade assembly shown in FIG. 35.
Figure 41B:
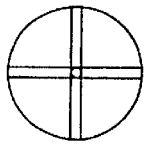

FIGS. 41*a.* and 41*b.* show a side and top view of a four faced blade assembly. A sized spacer/separator would look similar to this with its fins protruding less than the ones shown for the blades because the fins would not need to contact the target material.

Figure 42A:
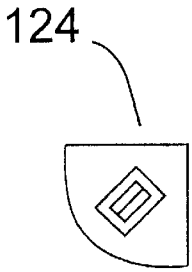
FIGS. 42*a*. and 42*b*. are bottom and side views, respectively, of a decorating nib with internal cutter shown in FIG. 35.
Figure 42B:
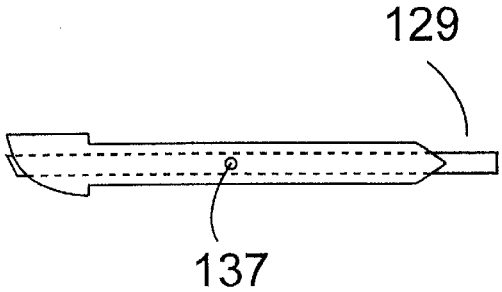

FIGS. 42*a.* and 42*b.* show a bottom and side view of a nib 124 with internal cutter 129 held together by a blade to nib attachment means 137 and the friction made by the assembly itself.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A decorating and cutting device for use with a target material comprising:

a housing;

cutting blade having first and second ends, said first end being attached to said housing and said second end including a cutting edge for creating a cut in the target material, the cut having an edge;

a decorating material dispenser having first and second ends, said first end being attached to said housing and said second end adapted to dispense decorating material onto the target material adjacent the cut in an area extending along the cut and from about the edge of the cut to a selected width; and said cutting blade cutting edge being disposed adjacent said dispenser, such that cutting of the target material by said cutting edge and dispensing of decorating material onto the target material in the area occur at about the same time.

2. The device of claim 1 and further including:

a decorating material storage area disposed within said housing and in communication with said first end of said decorating material dispenser.

3. The device, of claim 1 and further including means for biasing said cutting edge and said second end of said dispenser, such that said cutting edge and said second end of said dispenser extend beyond said housing.

4. The device of claim 1 and further including means for moving said cutting edge between a first position within said housing and a second position extended beyond said housing.

5. The device of claim 1 and further including means for moving said second end of said dispenser between a first position within said housing and a second position extended beyond said housing.

6. The device of claim 1 wherein said housing including a shoulder adapted to engage a template.

7. The device of claim 1 and further including means for rotating said blade within said housing.

8. The device of claim 1 and further including means for rotating said dispenser within said housing.

9. The device of claim 1 wherein said housing includes roller bearings adjacent said cutting edge.

10. The device of claim 1 wherein said housing includes a spring for biasing said cutting edge and said second end of said dispenser within said housing.

11. A decorating and cutting device for use with a target material comprising:

a housing:

a cutting blade having a cutting edge and attached to said housing, said cutting edge for creating a cut in the target material, the cut having an edge;

a decorating material dispenser for dispersing decorating material onto the target material adjacent the cut in an area extending along the cut and from about the edge of the cut to a selected width, said cutting blade cutting edge being disposed adjacent said dispenser, such that said cutting edge and dispenser engage the target material for cutting the target material and dispersing decorating material onto the target material in the area at about the same time.

12. The device of claim 11 wherein said cutting blade includes a disc rotatably supported within said housing.

13. The device of claim 11 wherein said dispenser includes a wheel rotatably supported within said housing.

14. The device of claim 11 and further including:

a decorating material storage area disposed within said housing and in communication with said decorating material dispenser.

15. The device of claim 11 and further including means for biasing said cutting edge and said dispenser, such that said cutting edge and said dispenser extend beyond said housing.

16. The device of claim 11 wherein said housing including a shoulder adapted to engage a template.

17. The device of claim 11 wherein said housing includes roller bearings adjacent said cutting edge.

18. The device of claim 11 wherein said housing includes a spring for biasing said cutting edge and said dispenser within said housing.

19. A decorating and cutting device for use with a target material comprising:

a housing;

a plurality of spaced apart cutting blades attached to said housing each of said blades for creating a cut in the target material, the cut having an edge; and a plurality of spaced apart decorating material dispensers attached to said housing and being disposed adjacent said plurality of cutting blades cutting edges for dispensing decorating material onto the target material adjacent the cut in an area extending along the cut and from about the edge of the cut to a selected width, such that ones of said plurality of cutting blades and ones of said plurality of dispensers extend from said housing for cutting the target material and decorating the target material in the area at about the same time.

20. The device of claim 19 and further including:

a decorating material storage area disposed within said housing and in communication with said plurality of decorating material dispensers.

21. The device of claim 19 and further including means for biasing said cutting blades and said dispensers, such that said cutting blades and said dispensers extend beyond said housing.

22. The device of claim 19 wherein said housing includes roller bearings adjacent said cutting edge.

23. The device of claim 19 wherein said housing includes a spring for biasing said cutting blades and said dispensers within said housing.

* * * * *